US009737788B1

(12) United States Patent
Pierce

(10) Patent No.: US 9,737,788 B1
(45) Date of Patent: Aug. 22, 2017

(54) DETACHABLE CHAIR LIFT LEG REST AND METHOD OF USE

(71) Applicant: Richard Alan Pierce, Wolfeboro, NH (US)

(72) Inventor: Richard Alan Pierce, Wolfeboro, NH (US)

( * ) Notice: Subject to any disclaimer, the term of this patent is extended or adjusted under 35 U.S.C. 154(b) by 0 days.

(21) Appl. No.: 15/165,710

(22) Filed: May 26, 2016

(51) Int. Cl.
*A63C 11/00* (2006.01)
*A63C 11/22* (2006.01)

(52) U.S. Cl.
CPC ..... *A63C 11/228* (2013.01)

(58) Field of Classification Search
CPC ..... A63C 11/228; A63C 11/227; A63C 11/22
USPC ..... 280/812, 813, 819, 820
See application file for complete search history.

(56) References Cited

U.S. PATENT DOCUMENTS 3,001,483 A * 9/1961 Gmeiner ..... A63C 11/22 104/173.2
3,179,436 A * 4/1965 Choy ..... A45B 5/00 135/66
3,350,111 A * 10/1967 Sahlein ..... A63C 11/22 15/236.01
3,995,382 A * 12/1976 Smith ..... A43B 23/082 36/72 R
4,196,742 A * 4/1980 Owen, Jr. ..... A63C 11/221 135/66
4,299,409 A * 11/1981 Gedicks ..... A63C 11/22 135/66
4,341,400 A * 7/1982 Morgan ..... A63C 11/22 280/819
4,358,138 A * 11/1982 Laughlin ..... A63C 11/22 135/66
4,556,252 A * 12/1985 Serex ..... A47C 16/02 280/809
4,582,341 A * 4/1986 Erickson ..... A63C 11/001 280/819
4,589,681 A * 5/1986 Erickson ..... A63C 11/001 135/66
4,718,138 A * 1/1988 Brown ..... A63C 11/22 15/237

(Continued)

FOREIGN PATENT DOCUMENTS

WO 9204086 A1 3/1992
WO 9847583 A1 10/1998
WO 2014080235 A1 5/2014

*Primary Examiner* — Jeffrey J Restifo
(74) *Attorney, Agent, or Firm* — McInnes & McLane, LLP

(57) ABSTRACT

A detachable chair lift leg rest is disclosed. The leg rest includes a lower attachment member and an upper attachment member which are removably secured to the shaft of a ski pole. The disclosure also includes a hanger that is either permanently or removably secured to a ski boot. In one embodiment, lightweight hooks, are spaced apart so that when a skier is on a chairlift, the lower hook is parallel to the ski boot and the upper hook is at the correct height to attach to the chairlift's restraint bar creating a ninety degree angle between the skier's knees and their torso. The lower engagement member is hooked to the hanger on the ski boot and the upper engagement member is engaged with the restraint bar of the chair lift. The ski pole with the upper and lower engagement members affixed allow the weight of the skier's legs, boots, and skis to hang from the restraint bar thereby reducing the strain on the skier's body, specifically the skier's knees.

18 Claims, 10 Drawing Sheets

(56) References Cited

U.S. PATENT DOCUMENTS

| | | | | | |
|---|---|---|---|---|---|
| 4,786,082 | A * | 11/1988 | Swietlik | A45B 5/00 | 135/66 |
| 4,940,255 | A * | 7/1990 | Donine | A63C 11/001 | 224/240 |
| 4,953,892 | A * | 9/1990 | Adkins | A63C 11/228 | 280/814 |
| 5,056,545 | A * | 10/1991 | Spaeth | A45B 1/00 | 135/66 |
| 5,083,813 | A * | 1/1992 | Adkins | A63C 11/228 | 248/340 |
| 5,178,413 | A | 1/1993 | King | | |
| 5,261,699 | A * | 11/1993 | Marston | A63C 11/22 | 280/816 |
| 5,313,719 | A * | 5/1994 | Koethe | A43C 13/14 | 36/136 |
| 5,653,467 | A * | 8/1997 | Griffin | A63C 11/001 | 280/809 |
| 6,321,470 | B2 * | 11/2001 | Zazzi | A63C 11/001 | 36/117.1 |
| 6,560,903 | B1 * | 5/2003 | Darley | A43B 3/0031 | 24/712.2 |
| 7,493,719 | B2 * | 2/2009 | Lackey | F41A 23/04 | 211/64 |
| 7,575,252 | B2 * | 8/2009 | Smith | A43B 5/0401 | 280/14.21 |
| 8,215,325 | B2 * | 7/2012 | Montanti | A45B 1/00 | 135/65 |
| 8,500,609 | B1 * | 8/2013 | Williams | A63C 11/228 | 135/65 |
| 8,813,407 | B1 * | 8/2014 | Sargent | F41A 23/16 | 42/94 |
| 2009/0058064 | A1 | 3/2009 | Ford, III et al. | | |
| 2015/0128665 | A1 * | 5/2015 | Ferraro | A63C 11/005 | 70/15 |

* cited by examiner

DETACHABLE CHAIR LIFT LEG REST AND METHOD OF USE

TECHNICAL FIELD

This disclosure generally relates to a device for supporting the legs of a skier while riding a chair lift, and more specifically, to a device that is supported on the ski poles to allow the skier to transfer the weight of their legs, boots, and skis to the chair lift restraint bar.

BACKGROUND

The sport of downhill skiing has been enjoyed by young and old for generations. Unfortunately, as people age, the use of the chair lift can put strain on a skier's knees. As a skier rides a chair lift in the seated position, the skier's knees need to support the weight of their ski boots and skis. For older individuals and people with compromised knee strength or knee injuries, this additional strain can make for an uncomfortable, and even painful lift ride and day of skiing. One solution is for a footrest to be provided on commercial ski chair lifts. However, not all ski chair lifts are equipped with a footrest, creating an uncomfortable ride for anyone with compromised knee strength or prone to knee pain. Adding to the problem is the fact that some ski resorts have a combination of lifts, some with footrests and some without. A skier does not know which lifts have a footrest ahead of time, often not until they are on or very close to the lift. Increasingly, commercial chair lifts do not have footrests, leaving skiers subject to unnecessary knee strain.

Various solutions have been attempted to provide relief to skiers in the past, but they have been ineffective for a variety of reasons. Prior attempts have included using the basket of the ski pole to support the weight of the legs, skis and ski boots, see for example U.S. Pat. No. 4,341,400. However, relying on the basket of the ski pole to support the weight of the skis and boots is awkward for the user and can be problematic because the ski pole basket is not designed for this use, subjecting it to stress that could cause it to break from the weight. In addition, where the basket of the ski pole is not designed for this purpose, the skier must concentrate on keeping their ski lined up on the basket for the entire chair lift ride as they try to balance their skis on the basket. Another attempt includes providing a platform attached to the ski poles on which the skier would balance their skis, see U.S. Pat. No. 4,582,341. Again, the platform requires balance and concentration by the skier for the duration of the ride on the chair lift. The platform also requires the skier to have the device attached to their ski poles all day.

As will be appreciated, the prior art designs do not allow for the skier to have a comfortable ride without having to actively position their skis and legs for relief.

SUMMARY

In contrast to the prior art that requires the skier to actively balance the weight of their legs on a small platform or basket, the present invention allows for a comfortable and concentration free ride on the chair lift. While not all chair lifts have a footrest, most chair lifts at commercial ski resorts do have a restraint bar that the skier lowers after they load the chairlift. It has been discovered that the strain on the skier's knees can be alleviated by transferring the weight of the legs, ski boots and skis through the ski poles to the chairlift itself, more specifically, to the restraint bar provided on all chair lifts. In order to transfer the weight, a pair of engagement members can be removably attached to a ski pole, the engagement members can then be engaged with the skier's boot and the restraint bar of the chair lift when the skier boards the lift, as described in greater detail below.

One embodiment of the present disclosure incorporates engagement members that are adjustably secured to the shaft of a ski pole and a hanger that may be removably secured to the ski boot. The engagement members are positioned on the shaft of the ski pole depending upon the preference of the user, which will be based upon the size of the user, particularly the length of the user's legs. One engagement member is positioned at a first location determined by where the upper engagement member will engage the restraint bar of a chair lift when embarked by a skier, and a second engagement member is placed at a second location, spaced distally from the first location, where the lower engagement member will engage with the ski boot when the skier is seated on the lift, in order to support the weight of the skier's legs as described herein.

In a first embodiment, the engagement members may be lightweight hooks, arranged in opposing directions. For example, the lower engagement member may be an upward facing hook, which removably secures the distal end of the ski pole to the ski boot by hooking onto a hanger, which may be removably secured to the ski boot. The upper engagement member, in this embodiment a downward facing hook, is removably engaged with the restraint bar of the chair lift. When the upper and lower engagement members are engaged with the ski boot and the restraint bar, the ski pole transfers the weight of the skis and ski boots to the bar itself. Because the weight of the skier's legs, skis, and boots are hanging on the restraint bar, the strain on the skier's knees is reduced; otherwise, the skier's legs, boots and skies would hang freely with the force of gravity. The present device can be used on any conventional chair lift without modification to the chair lift. The device is lightweight, and easily attaches to the equipment that is already carried by the skier. The skier does not need to carry any additional items in order to benefit from the relief provided. The equipment, once attached, also requires no additional assembly at the mountain. The detachable chair lift leg rest is designed to be compact and smooth, for example, with rounded edges, so that it is less likely to get caught on the skier's clothing.

The hanger or loop may be either removably secured to the skier's boot, as described above, or may be non-removably secured, i.e. in a more permanent manner. In either case, the hanger or loop has an opening to receive the engagement member and may be attached to the front of the ski boot so that when in use, the hanger is approximately perpendicular to the skier's leg. Once on the chairlift, the skier can easily use the lower engagement member to catch or hook the hanger or loop. The skier then engages the upper engagement member onto the restraint bar.

In another embodiment, a strap may be used to fasten the hanger or loop to the skier's boot. In this embodiment, the strap holds the hanger onto the boot so that the hanger is approximately parallel to the skier's leg. This embodiment is ideal for a skier that does not want to permanently or semi-permanently attach a hanger or loop to their boots.

In yet another embodiment, the tongue loop of the boot can be used as the hanger to engage the boot with the ski pole. In this embodiment, the tongue loop of the boot, which is generally designed to help the skier put on their boot, is reinforced. Where the tongue loop of the boot is used as the hanger, no additional hanger is required. Instead, the lower engagement member is engaged with the reinforced tongue loop instead of a separate hanger.

As the chair lift reaches the top of the mountain, the skier disengages the upper engagement member from the restraint bar by lifting the ski pole up and away from the restraint bar. The skier then lowers the ski pole thereby disengaging the lower engagement member. As the ski pole is lowered, the lower engagement member is released from the hanger.

The detachable chair lift leg rest described herein provides a lightweight, easy to use and efficient device for a skier to be comfortable on the chairlifts by reducing leg, and particularly knee strain. It is easy to attach and detach from the chairlift, and requires little additional effort or concentration on behalf of the skier. The skier simply loads the chairlift in the usual manner, and once in the seated position, lowers the restraint bar. After the restraint bar is lowered, the skier engages the lower engagement member with the ski boot by using the hanger, tongue loop, etc. Once the lower engagement member is attached to the boot, the upper engagement member is hooked onto the restraint bar by the skier raising the engagement member over the bar to engage the bar. When both engagement members are removably secured, the weight of the skier's legs, ski boots and skis is transferred through the ski pole and hangs from the restraint bar, thereby releasing the weight from the skier's knees and allowing for a comfortable, enjoyable, pain free ride.

After the lift reaches the top of the mountain, the skier first releases the upper engagement member from the restraint bar by lifting their poles up and away from the bar, then releases the lower engagement member by lowering the ski poles, lifts the restraint bar, and unloads in a normal manner. The skier can then continue down the mountain without any additional thought about the detachable chair lift leg rest until they get on the next chair lift.

BRIEF DESCRIPTION OF THE DRAWINGS

Various aspects of at least one embodiment are discussed below with reference to the accompanying figures, which are not necessarily drawn to scale, emphasis instead being placed upon illustrating the principles disclosed herein. The figures are included to provide an illustration and a further understanding of the various aspects and embodiments, and are incorporated in and constitute a part of this specification, but are not intended as a definition of the limits of any particular embodiment. The figures, together with the remainder of the specification, serve only to explain principles and operations of the described and claimed aspects and embodiments, but are not to be construed as limiting embodiments. In the figures, each identical or similar component that is illustrated in various figures is represented by a like numeral. For purposes of clarity, not every component may be labeled in every figure. Any figure that shows ski boots, skis, or a chair lift shows an exemplary product and is for illustrative purposes only.

DETAILED DESCRIPTION OF THE ILLUSTRATIVE EMBODIMENTS

Figure 1:
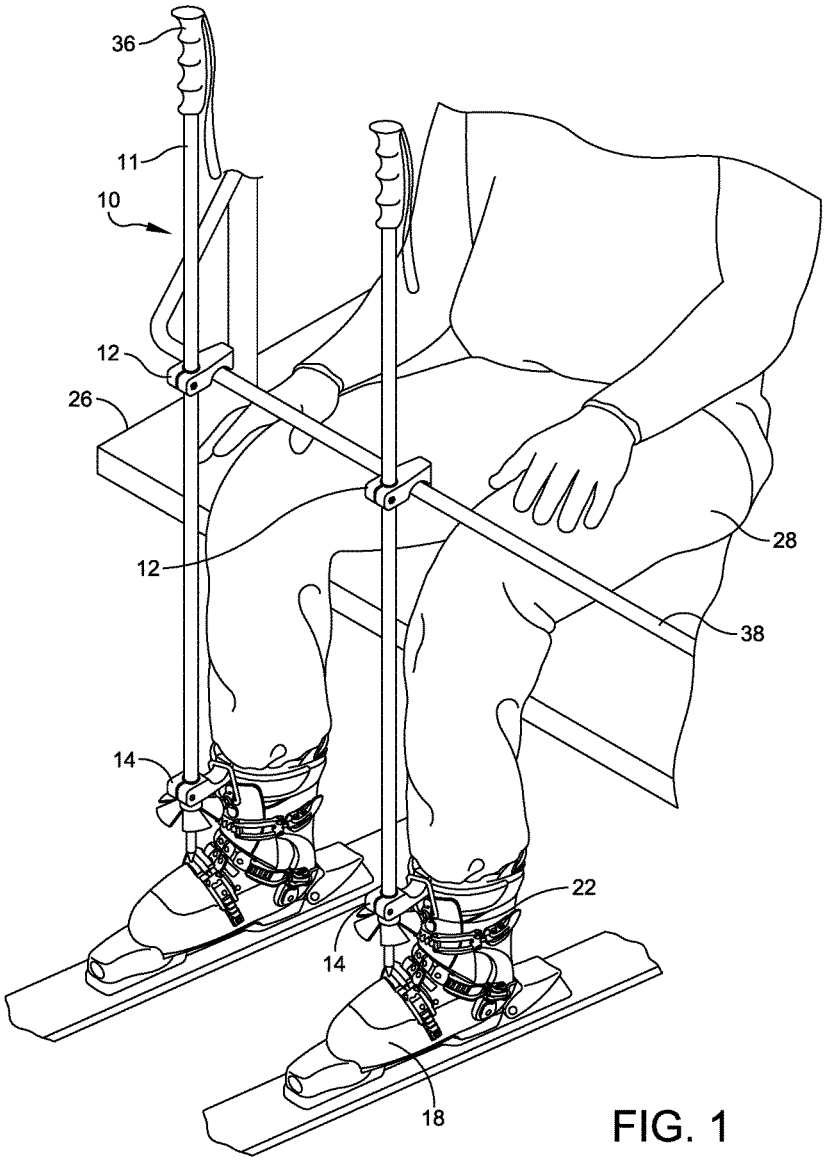
FIG. 1 is a front perspective view of the detachable chair lift leg rest according a first embodiment to the present disclosure.
Figure 2:
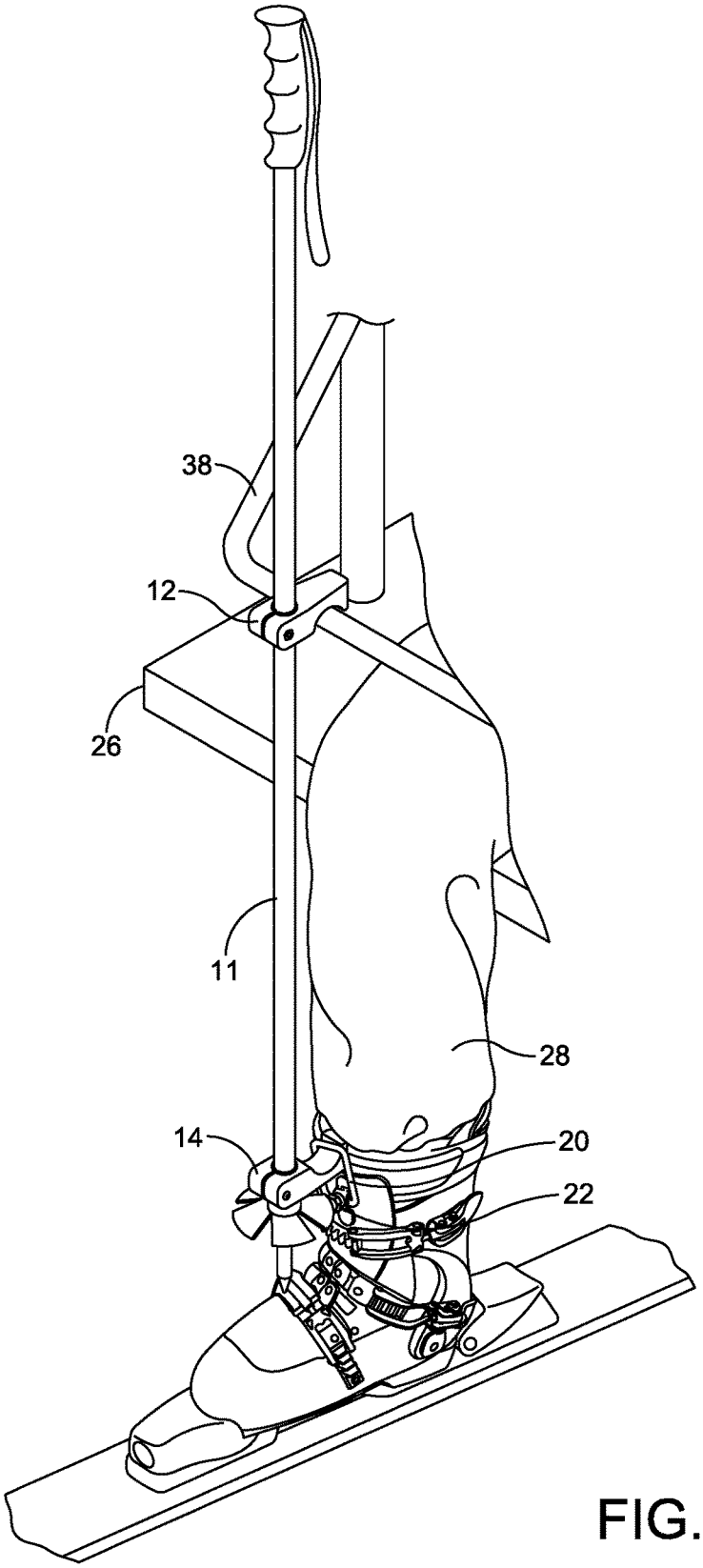
FIG. 2 is a front perspective view of the detachable chair lift leg rest of FIG. 1.
Figure 3:
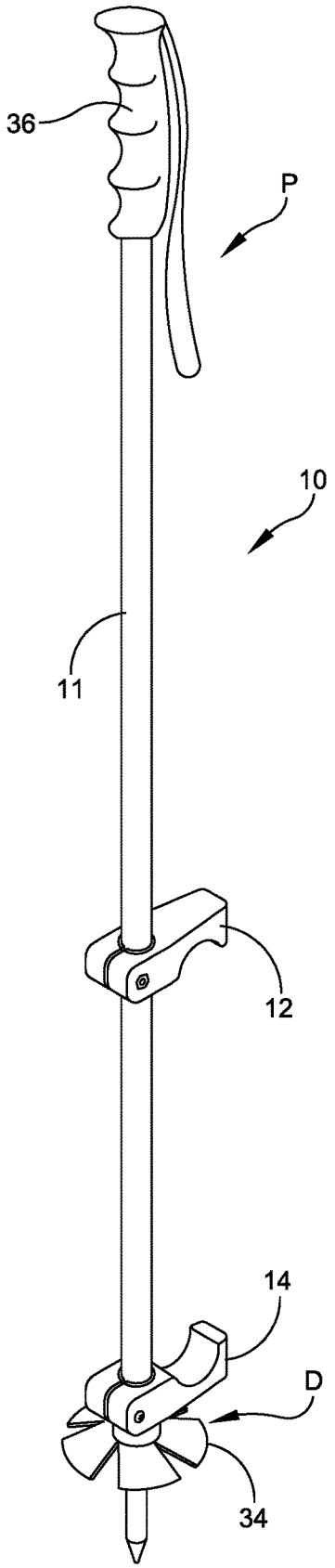
FIG. 3 is a front perspective view of the ski pole with the upper engagement member and lower engagement member of the leg rest of FIG. 1.
Figure 4:
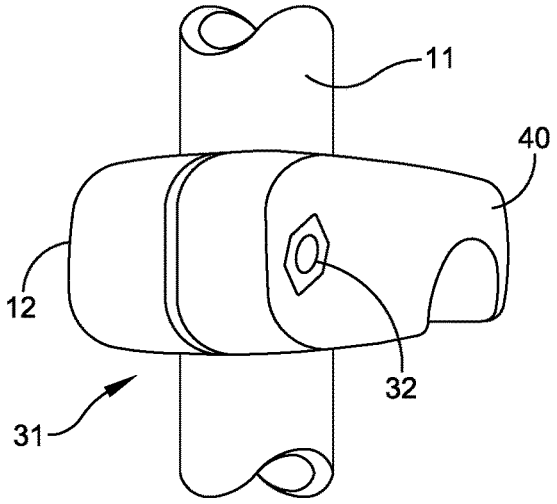
FIG. 4 is an exploded rear perspective view of the upper engagement member attached to the ski pole of FIG. 3.

The examples of the apparatus and method discussed herein are not limited in application to the details of construction and the arrangement of components set forth in the following description or illustrated in the accompanying drawings. It will be understood to one of skill in the art that the apparatus and methods are capable of implementation in other embodiments and of being practiced or carried out in various ways. Examples of specific embodiments are provided herein for illustrative purposes only and are not intended to be limiting. Also, the phraseology and terminology used herein is for the purpose of description and should not be regarded as limiting. Any references to examples, embodiments, components, elements or acts of the apparatus and method herein referred to in the singular may also embrace embodiments including a plurality, and any references in plural to any embodiment, component, element or act herein may also embrace embodiments including only a singularity. References in the singular or plural form are not intended to limit the presently disclosed apparatus or method, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. The skis, ski boots and chairlift shown in the illustrations are of exemplary products, and are not intended to be limiting. Any variety of ski, ski boot or chairlift can be used in the detachable chair lift leg rest disclosed herein. The detachable chair lift leg rest can be assembled with the ski pole shaft 11 and ski boots 18 prior to purchase of the products, or it can be a sold as an after-market kit which the skier can use on their existing equipment.

As shown in FIGS. 1-15, the detachable leg rest of the present disclosure includes a first engagement member 12 and a second engagement member 14, both of which may be removably secured to a ski pole 10 having a shaft 11 including a proximal end ("P") and distal end ("D") during use. The detachable leg rest also includes a hanger 20, which may be formed as a loop 30, or a strap 24, which may be permanently or removably secured to the ski boot. The hanger 20 is constructed and arranged so that it has a hanger opening 21 to receive an engagement member. The hanger opening 21 is defined by the hanger body 19. The proximal end of the shaft 11 of the ski pole 10 includes a grip 36 and the distal end includes a basket 34, as is conventional. In use, the first, proximal, or upper engagement member 12 may be secured to the shaft between a mid and upper portion of the shaft, depending upon the size of the user and the chairlift. The mid to upper portion of the shaft is that portion of the shaft extending from approximately the mid-point of the shaft to the proximal end of the shaft below the grip 36. The proximal engagement member 12 is used to engage the ski pole 10 with the bar 38 of the chair lift 26 and should be positioned accordingly along the shaft for hanging engagement of the ski pole. The lower engagement member 14 may be secured to the distal end of the shaft, below the mid-point of the shaft 11 and above the basket 34. The second, distal, or lower engagement member 14 is used to removably engage the pole with the ski boot 18 by engaging the hanger 20 through the hanger opening 21. Positioning of the lower engagement member 14 sufficiently above the basket to not cause interference by the basket is recommended.

One embodiment of a detachable chair lift leg rest is illustrated in FIG. 1. As shown in FIG. 1, the shaft 11 of a ski pole 10 includes lower engagement member 14, which may be a hook or other similar device, and an upper engagement member 12, which may also be a hook or the like, as would be known to one of skill in the art. The upper engagement member 12 and the lower engagement member 14 can be adjusted to allow the device to be used by skiers of any height. The upper engagement member 12 and lower engagement member 14 may be made of a lightweight material such as high-density polyethylene, or the like, as known to those skilled in the art. The present embodiment of the upper and lower engagement members 12, 14 show an arcuate shape with rounded edges to avoid snagging on the skiers clothing but may be have other shapes and finishes, as would also be known to those of skill in the art, provided that they removably engage the chairlift bar and ski boot as described herein below.

The upper and lower engagement members 12, 14, as best shown in FIGS. 4-9, each include a body 40 having an opening 15 sized to receive the shaft 11 of the pole therein so as to grip the shaft 11. The body 40 includes an attachment portion 31 to secure each of the engagement members 12, 14 to the shaft 11, for example by a locking member 32. The locking member 32 may be placed and secured at the correct height, as determined by the length of the skier's legs relative to the safety bar of the ski lift. The locking member 32 may be a self-clamping sex bolt, or the like designed to tighten and secure the attachment member in a clamping manner, as would be known to those of skill in the art. The locking member 32 may be recessed into the upper and lower engagement members 12, 14 in order to minimize the risk of injury or catching on clothing. In order to allow the upper and lower engagement members 12, 14 to fit on any circumference of ski pole 10, a bushing 16 may be inserted into the opening, as desired, 15 to create a more secure connection between the upper and lower engagement members 12, 14 and the shaft 11, as needed. The bushing 16, as are conventional and would be known to those of skill in the art, are available in a variety of thicknesses and, in addition to allowing a fit on any brand or size of pole, allow for a more secure friction fit on the ski pole 10 on any section of the shaft 11, regardless of where on the taper of the shaft 11 the skier 28 attaches the engagement member. In the embodiment shown in FIG. 4, the body 40 of the upper engagement member 12 has an arcuate indent whose size and geometry allows for engaging, latching, or resting the on the restraint bar 38. Alternately, other geometric shapes may be utilized, as would be known to those of skill in the art.

Figure 5:
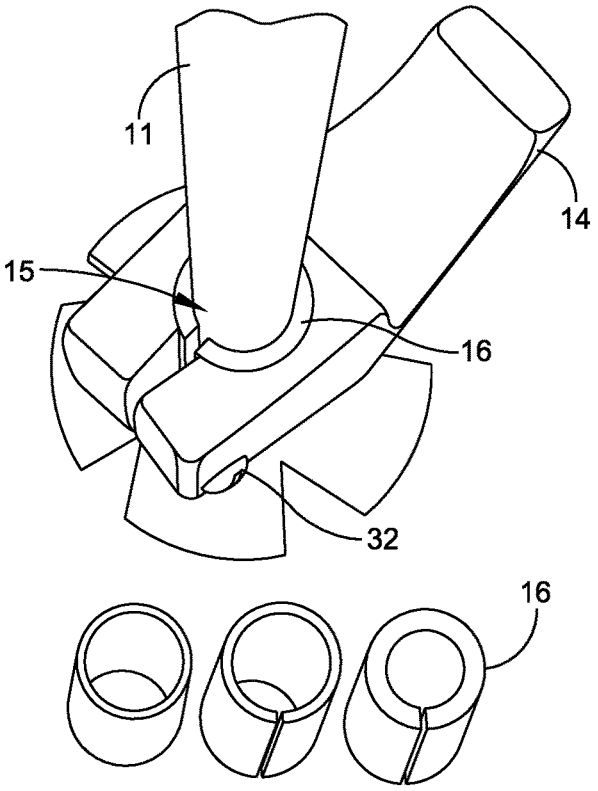
FIG. 5 is a exploded top perspective view of the lower engagement member attached to the ski pole and assorted bushings of FIG. 3.
Figure 6:
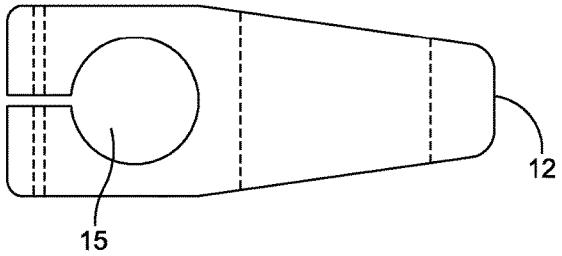
FIG. 6 is a bottom view of the upper engagement member of FIG. 3.
Figure 7:
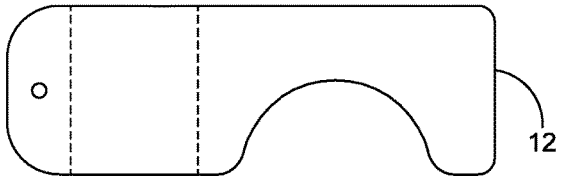
FIG. 7 is a side view of the upper engagement member of FIG. 3.
Figure 8:
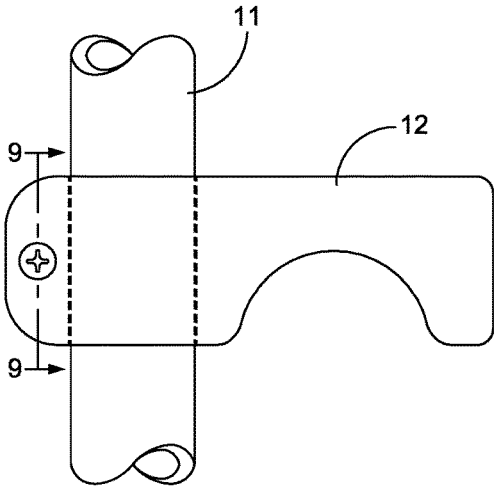
FIG. 8 is an exploded side view of the upper engagement member attached to the ski pole of FIG. 3.
Figure 9:
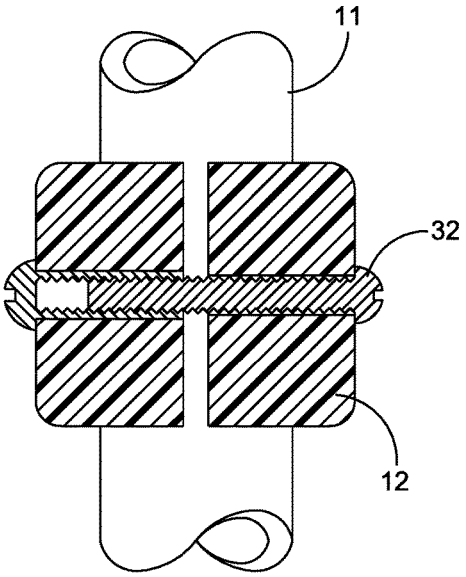
FIG. 9 is an exploded rear view of the upper engagement member of FIG. 3.

Referring now to FIG. 5, the body 40 of the lower engagement member 14 may also include an arcuate indent whose size and geometry allows for hooking, grabbing, or clasping the hanger 20. As illustrated and described above, the shaft 11 is inserted into the opening 15 of the lower engagement member 14, through a bushing 16, and the lower engagement member 14 is secured to the ski pole shaft 11 by the locking member 32. While the current illustrations show the upper engagement member 12 and the lower engagement member 14 as similar shapes and designs, the upper engagement member 12 and the lower engagement member 14 do not have to be the same, and each can have a different shape and geometry as would be understood by one of skill in the art.

Figure 10:
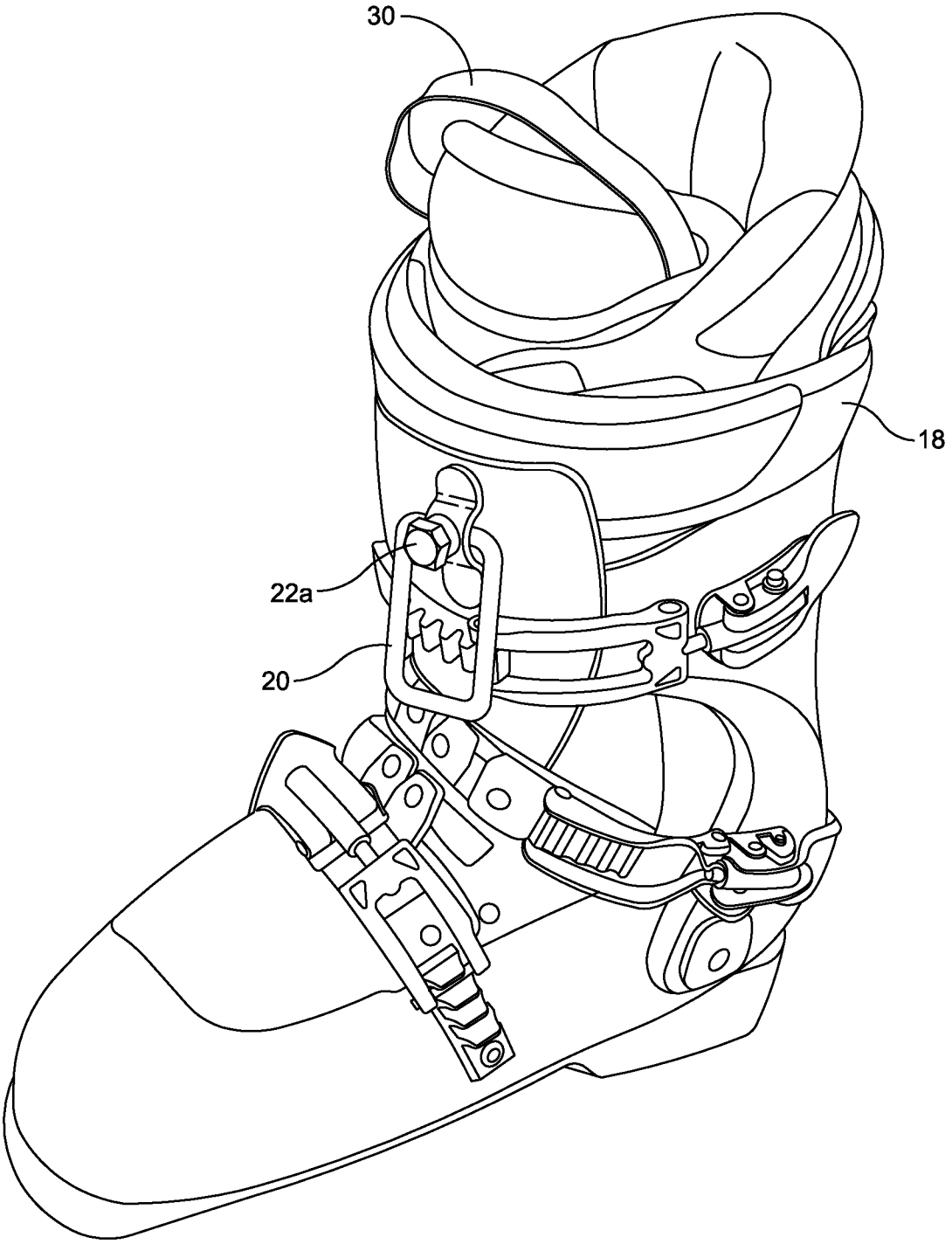
FIG. 10 is a front perspective view of the ski boot with the hanger attached of the leg rest of FIG. 1.
Figure 11:
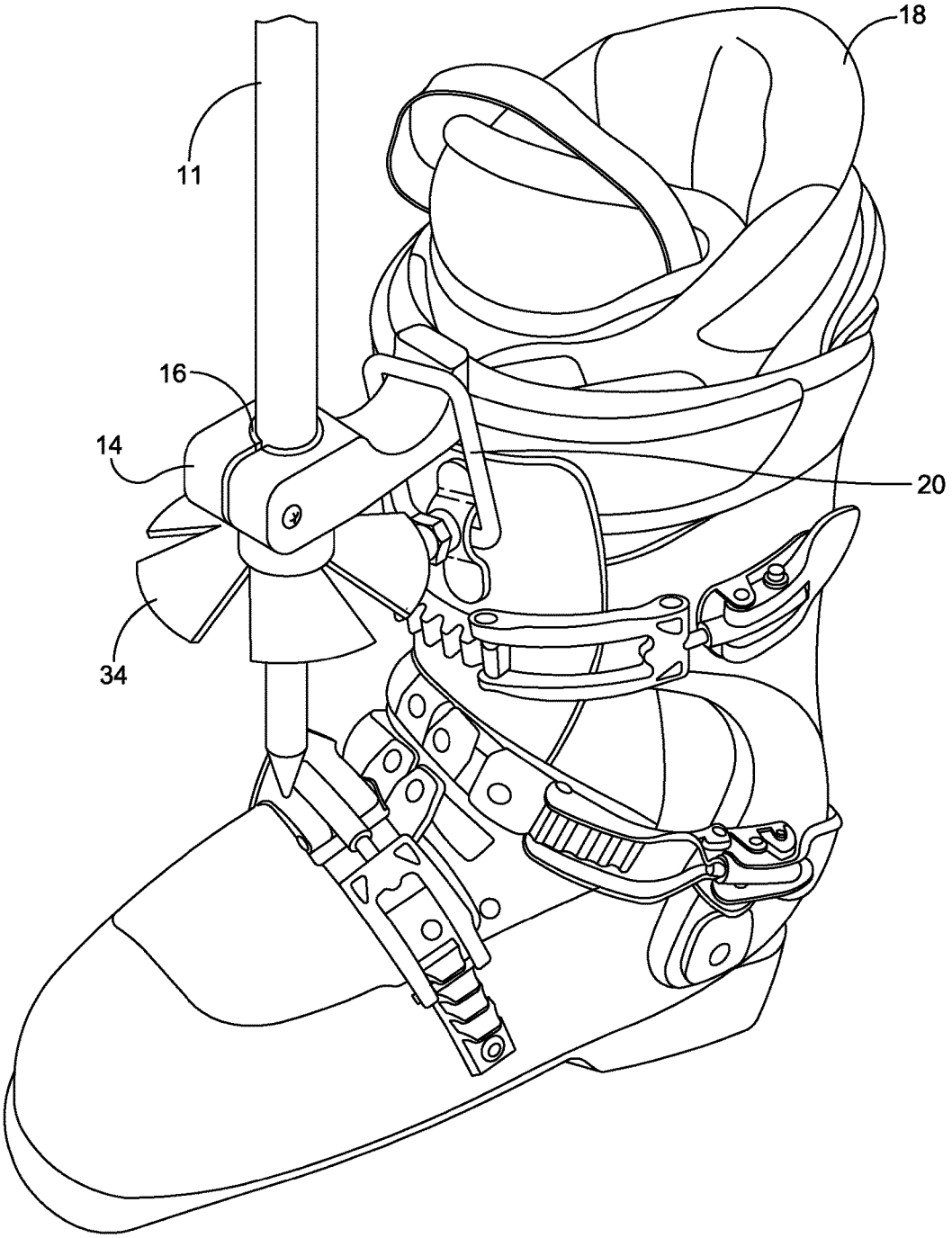
FIG. 11 is a front perspective view of a the ski boot with the hanger attached, the hanger being hooked to the lower engagement member of the leg rest of FIG. 1.
Figure 12:
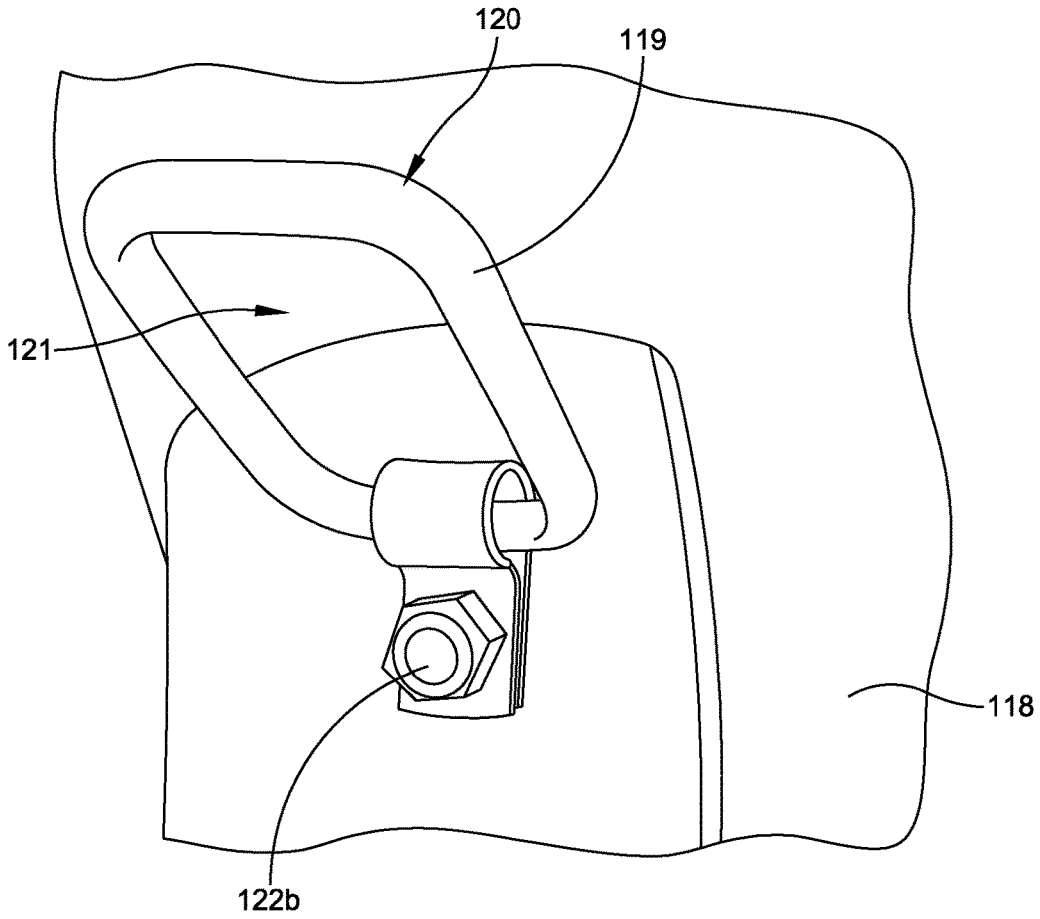
FIG. 12 is an exploded view of the hanger of FIG. 11, with an alternate fastener for attaching the hanger.

Referring now to FIGS. 10-13 various embodiments of attaching the lower engagement member 14 to the ski boot 18 by a hanger will be shown and described. As shown in FIG. 10, one embodiment includes the hanger 20 being removably secured to the ski boot 18 by a fastener, such as boot bolt 22. The boot bolt 22 may be any variety of fastener including a variety of bolts, such as a split ring hanger **22*a* as illustrated in FIGS. 10-11, a vibration loop clamp 22*b* as illustrated in FIG. 12, or any other bolt or the like that would function to removably secure the hanger to the ski boot, as would be known to those of skill in the art. The boot bolt 22 is easy to adjust by the user, and can even be adjusted with gloved hands, so that before riding the lift, the skier can tighten the boot bolt 22 and turn the hanger perpendicular to the boot, allowing the lower engagement member 14 to be hooked onto the hanger 20 with ease, as best shown in FIG. 11**.

Referring now to FIG. 12, another embodiment of the boot bolt is illustrated as a vibration loop clamp, which is also a conventional member known to those of skill in the art. In this embodiment, the same or similar elements of the embodiment of FIG. 1-11 are labeled with the same reference numbers proceeded with the numeral "1." In this embodiment, the boot bolt **122*b* is used to secure the hanger approximately perpendicular to the ankle of the boot. The vibration loop clamp is coated with rubber and when secured, the hanger 120 is held in place by friction with the rubber. Thus a single adjustment of the hanger 120 is possible. The embodiment of FIG. 12 utilizing a vibration loop clamp operates in the same manner as the previous embodiment shown and described to engage the hanger 120** with the lower engagement member.

Figure 13:
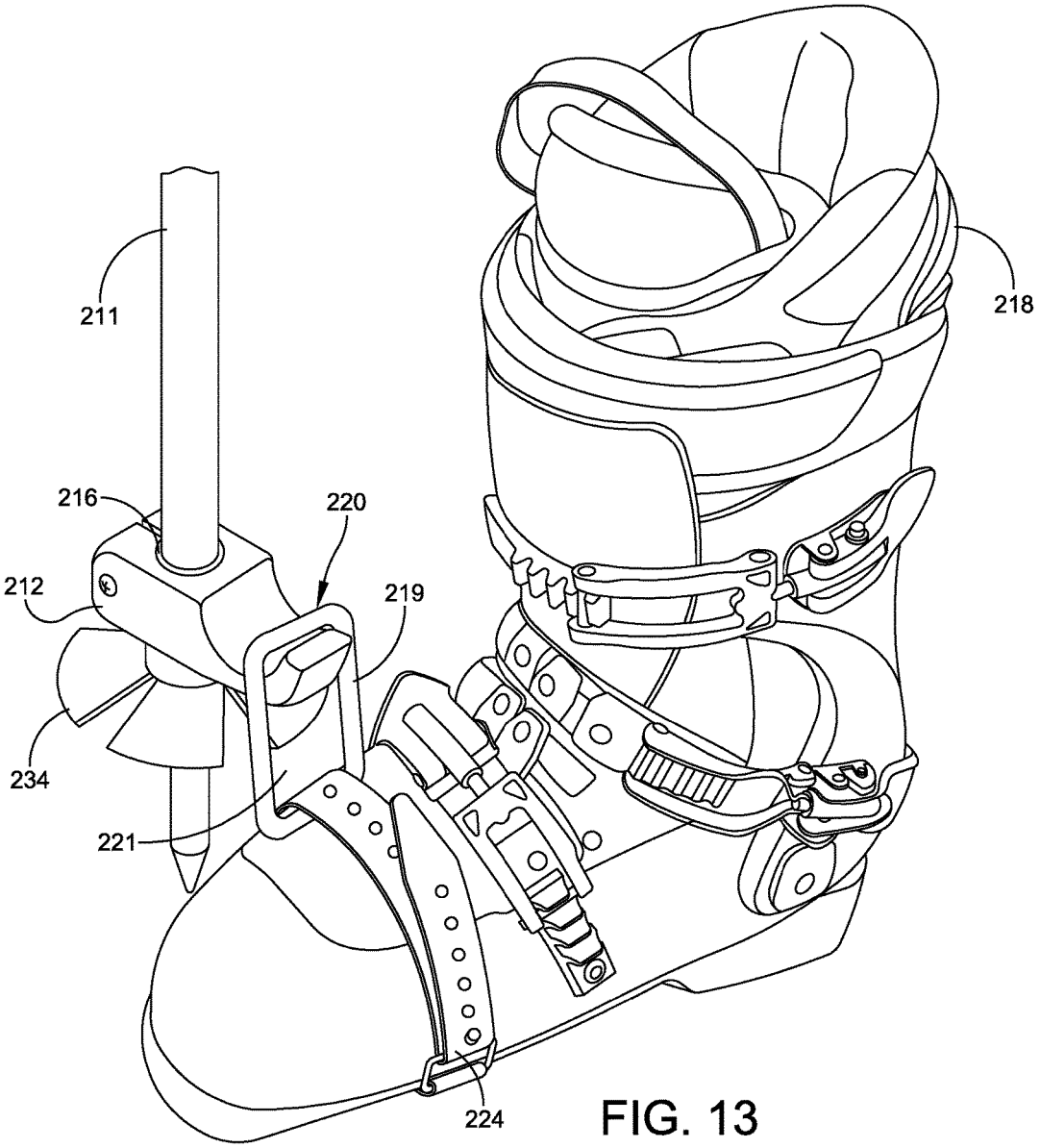
FIG. 13 is a front perspective view of another embodiment including a strap for attaching the hanger of the leg rest of FIG. 1.
Figure 14:
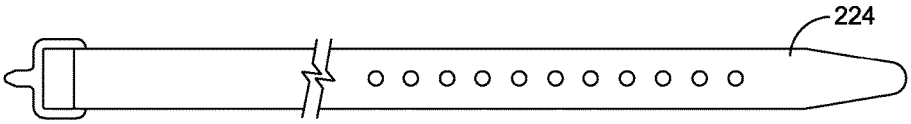
FIG. 14 is an exploded top view of the strap of FIG. 13.

Referring now to FIG. 13, in another embodiment of the disclosure, the hanger 220 is removably affixed to the ski boot 218 by a strap 224. In this embodiment, the same or similar elements of the previous embodiment are labeled with the same reference number proceeded with the numeral "2." The strap 224, as shown in FIG. 14, may be a stretchable ski strap or the like, provided around the ski boot. The strap allows the skier to removably secure the hanger 220 to the boot without drilling a hole into the ski boot as would be necessary to secure a bolt or the like. The strap is ideal for a skier who may be renting boots or otherwise cannot, or does not want to, permanently or semi-permanently change their ski boots. The strap can have a variety of configurations, thicknesses and lengths, and may be adjustable, as would be known to one of skill in the art. In the present embodiment, the hanger 220 is placed in a substantially vertical position by the skier to allow for the lower engagement member to attach to the hanger 220.

Figure 15:
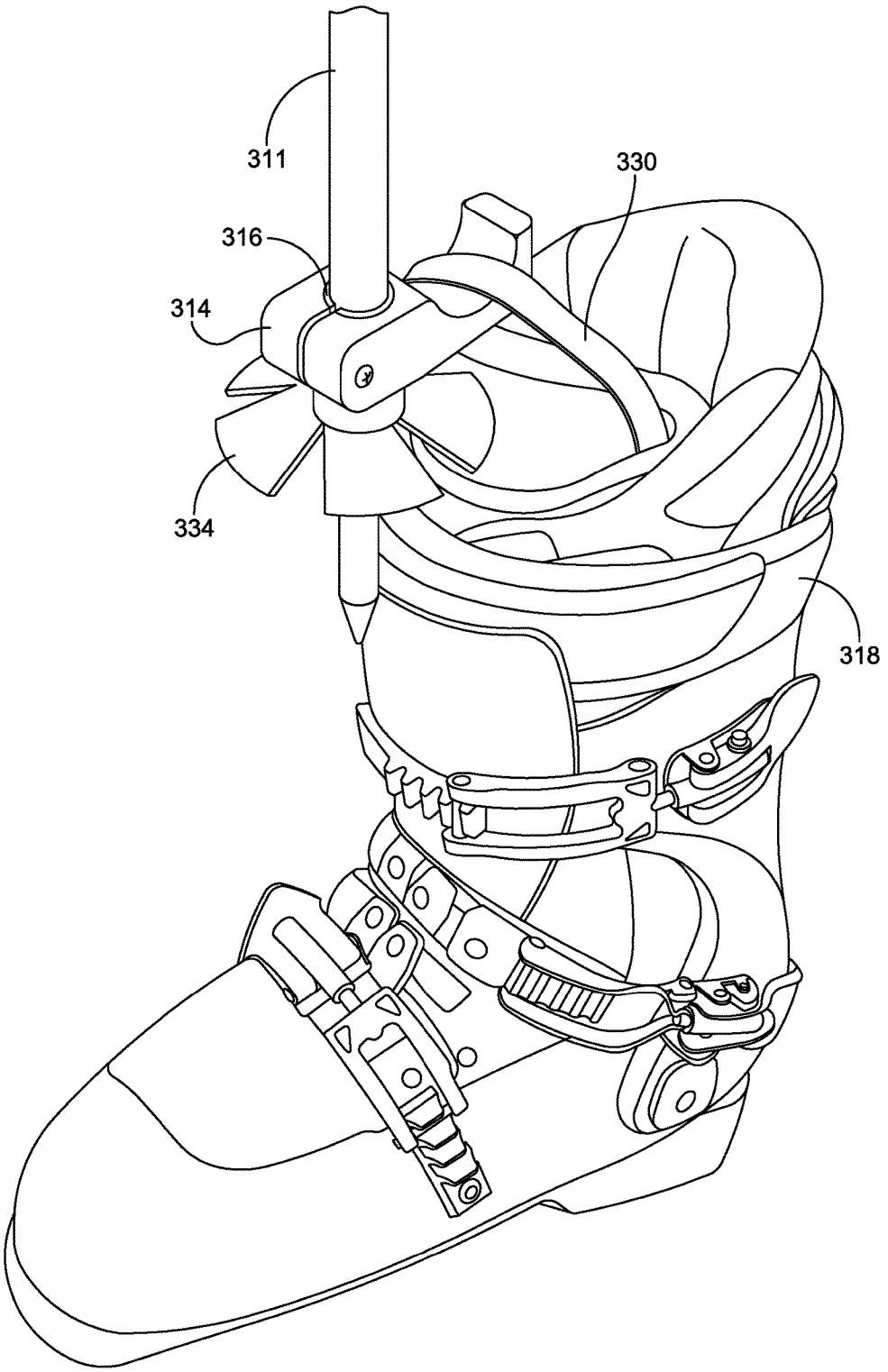
FIG. 15 is a front perspective view of an alternate embodiment including the ski boot with the tongue loop hooked to the lower engagement member of the leg rest of FIG. 1.

Referring now to FIG. 15, in another embodiment of the disclosure, the engagement member 314 is removably engaged with the tongue loop 330, that has been reinforced to support weight. In this embodiment, the same or similar elements of the previous embodiment of are labeled with the same reference numbers proceeded with the numeral "3." The tongue loop 330 allows the skier to removably secure the hanger 320 to the boot without drilling a hole into the ski boot as would be necessary to secure a bolt or the like. The tongue loop 330 is often a component of commercially available ski boots 318 and is used for assisting the skier with putting the boot on. In this embodiment, the tongue loop 330 is reinforced which allows for the skier to us it in place of adding an additional bolt or strap to the boot. In the present embodiment, the skier engages the lower engagement member 314 directly with the tongue loop 330.

Use of the detachable chair lift leg rest will now be described with reference to the FIG. 1. Prior to boarding the ski lift, either at home or in the lodge, the skier would attach the upper engagement member and the lower engagement member 12, 14, to the shaft 11 of the ski pole 10. The skier positions the engagement members such that when the skier is in a seated position and holds the ski pole in front of them approximately parallel to their body, the upper engagement member 12 is positioned so that it can engage with the chair lift restraint bar (approximately four to eight inches above the knee, depending on the height of the skier), and the lower engagement member is positioned so that it is at the distal end of the ski pole and it can engage with the ski boot hanger 20. The body of each engagement member is positioned so that the arcuate portion of the body 40 is directed toward the body of the skier when the skier is holding the ski pole by its grip. If the strap 24 is used, the lower engagement member is positioned so that the arcuate portion of the body 40 is perpendicular to the skier. The skier also either permanently or removably affixes the hanger 20 to the ski boot 18 as shown by the embodiments above.

Once at the mountain, the skier simply loads the chair lift in the normal manner, and once in the seated position, lowers the restraint bar 38. The skier engages the ski boot to the lower portion of the pole by means of the hanger 20, tongue loop 30, etc. as described above. Once the lower engagement member 14 is engaged with the boot, and after the restraint bar 38 is lowered, the skier lifts their poles and engages the upper engagement member 12 with the restraint bar. When both the upper and lower engagement member 12, 14 are attached, the weight of the skier's legs, ski boots and skis is transferred through the ski pole 10 and onto the restraint bar 38. Once the lift reaches the top, the skier releases the upper engagement member 12 from the restraint bar 38 by lifting their poles and the upper engagement member up and away from the restraint bar, then releases the lower engagement member 14 from the hanger 20 by lowering the ski poles, lifts the restraint bar 38, and unloads in a normal manner. The skier can then continue down the mountain without any additional thought about the detachable chair lift leg rest until they get on the next lift.

It will be understood by those skilled in the art that various changes in the form and details may be made herein without departing from the spirit and scope of the invention as defined by the appended claims. For example, the materials disclosed herein may be readily changed, as may the dimensions and geometric configurations. The upper and lower engagement members and the strap may be made out of a variety of materials. The bolts referenced are defined by example only and may be any bolt or attachment member known to those of skill in the art such as split ring hangers, vibration loop clamps, clamps, screws, or the like. Any variety of ski poles, ski boots, and skis may be used. The hanger referenced and shown may be any type of hanger, loop, support, carabiner, hook, or the like, of any shape with any size opening defined by a body that can receive the engagement member and may be made of any material that can support the weight of the ski boots, skis and poles.

The invention claimed is:

1. A detachable chair lift leg rest for use with a chair lift restraint bar and a conventional ski boot including a body, at least one buckle, and a sole, comprising:

a ski pole having a shaft including a proximal end and a distal end, opposite the proximal end, the ski pole including a grip adjacent the proximal end of the shaft;

a first engagement member and a second engagement member supported on the shaft of a ski pole, the second engagement member supported toward the distal end of the shaft and the first engagement member positioned a distance proximal to the second engagement member;

a hanger including an opening supported by a ski boot; and wherein during use, the lower engagement member engages the opening of the hanger and the upper engagement member engages the restraint bar of the chairlift so that the weight of the ski pole and the ski boot is transferred to the restraint bar to relieve stress on the skier's legs when the ski boot hangs from the engagement member, below the distal end of the ski pole.

2. The detachable chair lift leg rest of claim 1, wherein the lower engagement member and the upper engagement member are hooks positioned in opposite facing directions.

3. The detachable chair lift leg rest of claim 1, wherein the lower engagement member and the upper engagement member are adjustable along the length of the ski pole.

4. The detachable chair lift leg rest of claim 1, wherein the hanger is permanently affixed to the ski boot.

5. The detachable chair lift leg rest of claim 1, wherein the hanger is removably secured to the ski boot.

6. The detachable chair lift leg rest of claim 5, wherein the hanger is removably secured to the ski boot by a strap.

7. The detachable chair lift leg rest of claim 1, wherein the hanger comprises a tongue loop of the ski boot.

8. The detachable chair lift leg rest of claim 1, in combination with the ski boot.

9. The detachable chair lift leg rest of claim 1, wherein the lower engagement member and upper engagement member further comprise a locking member constructed and arranged to secure the engagement members to the shaft.

10. The detachable chair lift leg rest of claim 1, wherein the lower engagement member includes an arcuate indent constructed and arranged to engage with the hanger.

11. The detachable chair lift leg rest of claim 1, wherein the upper engagement member includes an arcuate indent to engage with the restraint bar.

12. The detachable chair lift leg rest of claim 1, further comprising a bushing constructed and arranged to secure the engagement member to the ski pole shaft.

13. The detachable chair lift leg rest of claim 1, wherein the ski pole includes a basket at the distal end of the pole, and the ski boot hangs below the basket.

14. A method of using a detachable chair lift leg rest with a chair lift restraint bar and a conventional ski boot including a body, at least one buckle, and a sole, comprising:

attaching a lower engagement member and an upper engagement member to a shaft of a ski pole, the second engagement member supported toward the distal end of the shaft and the first engagement member positioned a distance proximal to the second engagement member;

removably securing the lower engagement member to a hanger including an opening supported by a ski boot; engaging the lower engagement member with the hanger;

engaging the upper engagement member with the restraint bar of the chair lift;

wherein the weight of the skier's skis and boots will be transferred to the restraint bar and away from the body of the skier and the ski boot freely hangs below the distal end of the ski pole.

15. A kit of parts for a detachable chair lift leg rest for use with a chair lift restraint bar and a conventional ski boot including a body, at least one buckle, and a sole, comprising:

at least a first and a second engagement member, each engagement member comprising at least one of:

(a) an opening configured and dimensioned to receive the shaft of a ski pole;

(b) an arcuate engagement surface; and a hanger having a body and an opening disposed in the body;

wherein during use the first and second engagement members are affixed to the proximal end and distal ends of the shaft of a ski pole in opposite directions so that the engagement member at the proximal end engages with the restraint bar of a chair lift and the engagement member on the distal end of the ski pole shaft engages with the opening of the hanger supported by the ski boot, wherein the ski boot hangs below the distal end of the ski pole and weight of the ski pole and the ski boot is transferred to the restraint bar to relieve stress on the skier's legs.

16. The kit of claim 15 wherein at least one of the first engagement member and the second engagement member comprises a locking member.

17. The kit of claim 15 wherein at least one of the first engagement member and the second engagement member contains a bushing within the opening that receives the shaft.

18. The kit of claim 15, further comprising a strap constructed and arranged to removably secure the hanger to the ski boot.

* * * * *